United States Patent [19]

Fug

[11] 4,431,623

[45] Feb. 14, 1984

[54] PROCESS FOR THE PRODUCTION OF CARBON FIBRES FROM PETROLEUM PITCH

[75] Inventor: Gerrard Fug, Lavera, France

[73] Assignee: The British Petroleum Company p.l.c., London, England

[21] Appl. No.: 385,080

[22] Filed: Jun. 4, 1982

[30] Foreign Application Priority Data

Jun. 9, 1981 [GB] United Kingdom ..... 8117658

[51] Int. Cl.[3] ..... D01F 9/12; C10C 3/02

[52] U.S. Cl. ..... 423/447.1; 264/29.2; 423/447.4; 423/447.6; 208/22; 208/44

[58] Field of Search ..... 423/447.1, 447.2, 447.4, 423/447.6, 447.7, 447.8; 208/22, 39, 40, 44, 45; 264/29.2

[56] References Cited

U.S. PATENT DOCUMENTS

| | | | |
|---|---|---|---|
| 3,595,946 | 7/1971 | Joo et al. | 423/447.6 |
| 3,656,904 | 4/1972 | Ram | 423/447.7 |
| 4,197,283 | 4/1980 | Crepaux et al. | 423/447.1 |
| 4,351,816 | 9/1982 | Schulz | 423/447.6 |

FOREIGN PATENT DOCUMENTS

| | | |
|---|---|---|
| 51-105418 | 9/1976 | Japan . |
| 1307392 | 2/1973 | United Kingdom . |

*Primary Examiner*—Edward J. Meros
*Assistant Examiner*—Steven Capella
*Attorney, Agent, or Firm*—Morgan, Finnegan, Pine, Foley & Lee

[57] ABSTRACT

A method of producing carbon or graphite fibres from a pitch obtained from a steam cracking residue of a petroleum fraction which pitch has a $\beta$ resin content of from 2 to 40% by weight, comprises spinning the pitch into fibres at a temperature higher than the softening point, the fibres being treated to render them infusible and then subjecting the fibres to carbonization by heating, followed by graphitization if desired, characterized in that the treatment to infusibilize the fibres is controlled such that the resin content of the fibres does not exceed 30% by weight. The invention includes carbon and graphite fibres produced by the process.

5 Claims, No Drawings

PROCESS FOR THE PRODUCTION OF CARBON FIBRES FROM PETROLEUM PITCH

The present invention relates to a process for the production of carbon fibres from pitch derived from petroleum.

Carbon fibres at present marketed may be classified into three categories: (1) the classic fibres having a tensile strength (R) and a mean elasticity modulus (E) such that R is equal to approximately 2,100 N/mm$^2$ and E is equal to approximately 220,000 N/mm$^2$, (2) the high-strength fibres in which R is equal to approximately 2,500 N/mm$^2$ and E is equal to approximately 260,000 N/mm$^2$, and (3) the high-modulus fibres in which R is equal to approximately 2,000 N/mm$^2$ and E is equal to approximately 400,000 N/mm$^2$. Carbon fibres are used primarily in applications calling for a light material with good mechanical properties. Thus the fibres are used in the aerospace and aeronautic industries, particularly in supporting panels, frames, aerial supports for satellites, blades of the main rotor or tail rotor or transmission shafts of helicopters or, finally, in strategic missiles. Good prospects for carbon fibres are also foreseen in the car industry.

Carbon fibres may be manufactured, at the present time, either by carbonisation and/or graphitisation of polyacrylonitrile (PAN), or by stretching fibres with more modest properties derived from cellulose, coal tars, coal extracts or petroleum products at a rate of elongation of the order of 100% or over and at a temperature of the order of 2,500° C.

In either case, the cost of fibres is high because of the cost of the raw material, the low yield of fibres, and the complex treatments required.

Lower cost fibres are also known possessing, apart from the above mentioned mechanical characteristics, properties of chemical inertia, resistance to heat and electrical conductivity. They can be obtained from cellulose, coal pitches, petroleum extracts, or coal extracts. These fibres possess tensile strengths of the order of 500 to 1000 N/mm$^2$ and Young's moduli of 8,000 to 80,000 N/mm$^2$.

Processes for the preparation of such fibres are described in British Pat. No. 1,071,400 which describes a process using, as raw material, an organic material which is derived from synthetic organic substances (for example, synthetic high polymers such as polyvinyl chloride or polyacrylonitrile) by treatment under an inert atmosphere at 300° to 500° C.

British Pat. Nos. 1,091,890 and 1,208,894 and French Pat. Nos. 2052112, 2087413 and 2067619 describe related processes in which, however, the raw material has been previously converted to facilitate the spinning process and increase the mechanical properties of the fibres. Such processes include, particularly, the incorporation of sulphur, polymers such as polyethylene and polystyrene, plasticisers such as castor oil, or alkylated and sulphided derivatives.

British Pat. No. 1,208,894, French Pat. No. 2113351 and French Patent application No. 70 31246 describe processes using raw materials which have been treated previously with a solvent so as to extract the most volatile products prior to spinning. The solvents may be, for example, acetone, hexane, toluene or quinoline. French Patent application No. 71 45893 describes a process in which the raw material, which may be asphalt, bitumen, a coal pitch or tar or a petroleum pitch, is extruded into fibres which are then treated in the liquid phase with a nitric acid solution. Such processes, however, have the drawback of requiring supplementary treatment operations in the liquid phase and washing, which may affect the final quality of the fibre.

French Pat. Nos. 2178193, 2204571, 2253852 and 2296032 describe processes for the preparation of carbon fibres from a pitch which has been converted partly into liquid crystal or into the mesophase state. However, such processes use a treatment of the pitch prior to the spinning which may be long and difficult to control.

French Pat. No. 2392144 also describes a process for the preparation of carbon fibres from petroleum pitch, the resulting carbon fibres having mechanical strengths of between 300 to 800 N/mm$^2$.

The applicants have now discovered a process which makes it possible to prepare carbon or graphite fibres using a raw material derived from petroleum pitches and possessing better mechanical properties.

The fibres resulting from this process are also included within the invention.

Thus according to the present invention a process for producing carbon or graphite fibres from a pitch obtained from a steam cracking residue of a petroleum fraction, which pitch has a $\beta$ resin content of from 2 to 40% by weight, comprises spinning the pitch into fibres at a temperature higher than the softening point, the fibres being treated to render them infusible and then subjecting the fibres to carbonisation by heating, followed, if desired by graphitisation characterised in that the treatment to infusibilise the fibres is controlled such that the $\alpha$-resin content of the fibres does not exceed 30% by weight.

The petroleum pitches used in the process as defined above preferably contain from 3 to 35% of $\beta$ resins.

The softening point of the pitches used according to the invention is preferably between 150° and 250° C.

Pitch Preparation

Pitch for use in the present invention may be prepared according to a process comprising distilling a steam cracking residue of a petroleum fraction, particularly a naphtha fraction, until the pitch reaches a softening point of between 55° and 90° C., and then ageing this pitch until it reaches a softening point of between 85° and 110° C. The ageing temperature is preferably between 350° and 450° C. The pitch thus obtained, however, still contains some volatile products which it is best to eliminate so as to facilitate the operation of spinning as well as the subsequent treatments of the fibres.

These pitches consist in the main of polycondensed aromatic derivatives having widely varying molecular weights, their extent of aromaticity being higher than 96%. They contain different resins, which may be defined by extraction with various solvents in the following manner.

- $\alpha$ resins which are products which are insoluble in quinoline or in an anthracene cut,
- $\beta$ resins which are products insoluble in toluene or benzene but soluble in quinoline or anthracene oil,
- $\gamma$ resins which are products insoluble in n-hexane but soluble in toluene or benzene,
- $\delta$ resins which are products soluble in n-hexane, benzene and toluene.

The behaviour of these different resins during carbonisation is different. The rate of polycondensation increases on going from the $\delta$ resins to the $\alpha$ resins. The result of this is that the amount of carbon obtained after treatment at high temperature also increases when passing from the δ resins to the α resins.

The products from these resins are also different. Thus, the δ resins and γ resins as well as the crude pitch give rise to the formation of graphitised products, whilst the α and β resins do not form graphitised products. This may be explained by the fact that the conversion of the α and β resins into coke does not go through an anisotropic liquid phase whereas, on the other hand, the pitch and also the δ and γ resins form a liquid phase known as mesophase with gives rise to the formation of graphitised products.

The δ and γ resins, because of their properties, act as a matrix in relation to the α and β resins.

For the purposes of the present invention, the proportion of β resins must not be too large because the thermal treatment of the fibres at high temperatures, particularly higher than 2,500° C., would not convert the fibres into a polycrystalline graphite structure. With too high a content of β resins, a separation of phases may also occur, leading to a heterogeneous pitch which is difficult to spin.

The pitches of petroleum origin, and in particular those prepared by the process described in French Pat. No. 2250571, may therefore be treated in such a way as to give products containing, as stated above, a percentage of β resins which may range up to 2 to 40% and more particularly between 3 and 35% and a content of δ resins of between 10 and 40% by weight. The pitches may be modified by a supplementary thermal treatment which increases their Kraemer-Sarnow softening point, determined according to the test method known as Normes Francais T 6700 1, whilst avoiding a greater condensation of the resins. This thermal treatment makes it possible to concentrate β resins in the medium and to eliminate a part of the light products, such as the δ resins, which may cause difficulties during the subsequent thermal treatments.

The supplementary thermal treatment, however, must be carried out in such a way that the products with a lower molecular weight, which serve as fluxes and binders for the resins are not completely eliminated. The formation of a macromolecular substance which could not be spun correctly in the molten state is thus avoided. Furthermore, the elimination of too large a quantity of light products would considerably increase the softening point of the material to be spun, and consequently the spinning temperature. Too high spinning temperatures are desirably avoided because such temperatures would risk bringing about a thermal conversion of the pitch which would lead to fibres having an irregular diameter. For this reason the δ resin content is preferably between about 10 and 30% by weight.

The thermal treatment to remove a part of the light products can be carried out in various ways.

It is possible to continue the thermal ageing mentioned above until a pitch possessing the softening points and the resin contents mentioned above is obtained.

Alternatively, the pitch may be stripped with an inert gas (e.g. nitrogen, argon or helium), at temperatures lower than 350° C. and preferably at a temperature lower than 300° C. This treatment avoids the additional formation of more highly concentrated resins.

Another treatment may be distillation in vacuo at a pressure less than 5 to 10 mm of mercury and at temperatures below 350° C.

The thermal treatment eliminates a part of the light products, as shown by a narrowing of the distribution curve of number average molecular weights ($\overline{M}n$), without an appreciable increase in the weight average molecular weight ($\overline{M}w$).

A thermal treatment carried out at a temperature lower than the cracking temperature of the carbonaceous products also has the advantage that there is no formation of new products of low molecular weight nor any recondensation of the molecules.

The pitches thus obtained are particularly suitable for spinning in the molten state since they possess the above mentioned content of β and δ resins, KS softening points of between 150° and 250° C. and more particularly between 180° C. and 250° C.

These treatments can be carried out rapidly in the space of a few hours, with yields of final pitch in excess of 75%.

It is possible also, at this stage of the operation, to increase the proportion of β resins in the initial pitch by a mild ageing of the raw material at temperatures in the region of 380° C.

The resultant pitches have a rheological behaviour suitable for spinning and drawing into fibres. In fact, the pitch behaves as a Newtonian fluid, its flow through the die being uniform and regular. Too large a quantity of β resins in the pitch would produce a colloidal solution of macromolecules of high molecular weights which would not be spinnable.

The treatment of the petroleum residues as defined above also makes it possible to prevent the formation of α resins (which are insoluble in quinoline) which can form a second solid phase and which can, at the moment of drawing, give rise to stresses at the outlet from the die. This, in turn, may reduce the mechanical strength of the filament and give rise to irregularities. The content of α resins may be less than 1% and is, preferably, less than 0.2%.

Another advantage of the use of these pitches for producing carbon fibres, lies in the fact that they only contain carbon and hydrogen. Coal tar pitches also contain sulphur, nitrogen and oxygen, which are detrimental to the quality of the fibres.

Another method of preparation of pitches suitable for the production of carbon fibres is described in U.K. Patent Application No. (Case 5189) filed simultaneously with the present Application and claiming priority from U.K. Patent Application No. 8117657 filed on June 9, 1981.

This method is a continuous process for the treatment of a steam cracking residue of a petroleum fraction carried out so that a pitch of KS softening point of 150°-250° C. and having the above mentioned content of β, δ and α resins is obtained in two reactors in series rather than the three stages of the process described above.

A third method of preparation of pitches with low β resin content suitable for the production of carbon fibres comprises a two stage process involving first a continuous distillation of the steam cracking residue to remove between 30 and 50% wt of light products. The subsequent residue having a KS softening point lower than 40° C. is, in the second stage, further heat treated under reduced pressure until the pitch reaches the above mentioned characteristics.

The raw material thus obtained containing between 2 and 40% of β resins and, preferably, 10 to 40% of δ resins and less than 1% of α resins, is then subjected to treatments which are in themselves known for the production of carbon fibres, consisting of filtering through sand beds and then spinning the product in the molten state, oxidising the fibres to render them partially infusible, carbonising the resultant fibres and if desired graphitising them.

Spinning

The spinning of the pitch is carried out by classic techniques, for example, by normal melt spinning, by centrifugal spinning, by spinning with simultaneous gas blowing, etc. The temperature of spinning depends upon the temperature at which the pitch has a suitable viscosity. This temperature depends particularly on the softening point of the pitch and its viscosity; for example, pitches containing approximately 30% of $\beta$ resins having a softening point of 150° C. have a viscosity of about 60 poises at a spinning temperature of 250° C., whereas pitches containing 35% of $\beta$ resins and having a softening point of 180 have a viscosity of about 600 poises at a temperature of 280° C.

The fibres are preferably spun from pitches such as those defined above at a rate of about 300 m per minute to about 1,800 m per minute, preferably 500 to 1,500 m per minute, within a viscosity range of between 60 poises and 600 poises.

When spinning the product in the molten state, the fibres obtained have a variable diameter of between 5 and 20$\mu$. This diameter may vary according to the draw-off rate (which is the ratio between the diameter of the fibre and the diameter of the thread as it leaves the die) and the feed rate (which also depends on the viscosity of the product and therefore on the spinning temperature, the pressure and the diameter of the die). One may thus decrease the diameter of the fibre by increasing the rate of draw-off or by decreasing the feed rate. However, the spinning temperature must not be too high (because in such a case the viscosity would be too low and would cause liquid flow in the fibres) nor must it be too low (because in this case the product would become too viscous and could not be suitably drawn).

Infusibilisation

The fibres are then subjected to treatment to render them infusible, thus making it possible to treat them subsequently at high temperature without the risk of the fibre adhering to or fusing with each other.

The temperature at which this treatment is carried out should, clearly, not exceed the temperature at which the fibres soften or undergo distortion.

It has been found that this infusibilisation treatment has a very marked effect on the quality of carbon and graphite fibres produced and that it is important to control the infusibilisation treatment to keep the production of $\alpha$ resins to a minimum at this stage.

If, for example, the infusibilisation treatment is an oxidation treatment carried out with oxygen or air at a temperature of circa 250° C., then the pitch fibres are converted to material that is substantially 100% $\alpha$ resins (i.e. material insoluble in quinoline). Such oxidised fibres can be converted to carbon fibres by carbonisation but the fibres have only a moderate tensile strength and modulus of elasticity. Further such oxidised fibres cannot be graphitised in the true sense that a polycrystalline graphitic structure is produced.

In the present invention the infusibilisation treatment is, therefore, controlled so that the infusibilised fibres have an $\alpha$ resin content which does not exceed 30% wt and preferably does not exceed 25% wt.

Suitable treatments which can be controlled to render the fibres infusible without increasing the content of $\alpha$ resins beyond the stated amounts may be selected from:

(a) treatment with a mixture of NO and $O_2$ at a temperature not exceeding 200° C., (b) treatment with a halogen in gaseous form combined with a treatment with $O_2$ at a temperature not exceeding 250° C., (c) treatment with $SO_2$, in admixture with $O_2$ if desired, at a temperature not exceeding 300° C.

Infusibility may be defined as a quality such that the fibres do not deform at temperatures up to the temperature at which carbonisation commences (e.g. 250° C.) and so can be safely handled and stored prior to carbonisation. Other infusibilisation treatments may also be possible, subject only to the requirement that the increase in $\alpha$ resin content is minimised.

British Pat. No. 1,307,393 and Japanese Patent Application No. J51105418 disclose the use of $SO_2$, halogens and NO in admixture with oxygen to influsibilise pitch fibres. However, neither of these publications suggest the method of the present invention wherein the treatment to infusibilise the fibres is controlled so as to limit the production of $\alpha$-resins such that the $\alpha$ resin content of the pitch fibres does not exceed 30% more preferably 25%, by weight.

The parameters of the infusibilisation treatment, such as temperature, duration, rate of increase of the temperature, gas flow rate, and gas composition are controlled in order to control the production of $\alpha$-resins. The parameters for a particular pitch composition and fibre size may be selected by carrying out simple experiments and measuring the $\alpha$ resin content of the infusibilised fibres.

The infusibilisation treatment according to the present invention affects the properties of the carbon fibres produced from the pitch fibres but has a greater effect on the properties of the graphite fibres. By suitable treatments as defined above followed by carbonisation at 1,000° C. it has been found possible to produce carbon fibres having tensile strengths (R) of over 800 $N/mm^2$ and up to at least 1,900 $N/mm^2$ and elasticity moduli (E) of over 30,000 $N/mm^2$ and up to at least 90,000 $N/mm^2$. Further increases in R and E are possible by graphitisation to give graphitised fibres having tensile strengths (R) of over 1,150 $N/mm^2$ and elasticity moduli (E) of over 140,000 $N/mm^2$.

Carbonisation

The carbonisation of the infusibilised fibres is carried out by heating (e.g. from 500° to 2,500° C.) under an inert atmosphere, e.g. a flowing stream of nitrogen, argon, hydrogen or helium. During the course of this treatment the fibres are freed from their lightest constituents, which are carried away in the stream of carrier gas.

A suitable carbonisation treatment may be as follows. Between 250° and 300° C. there is a rapid rate of increase of temperature which may be between about 60° and 300° C. per hour; between 300° and 500° C. the rate of increase of temperature is low and it is preferably between about 20° and 60° C. an hour, while between 500° and 1,000° C. the rate of increase of temperature is very rapid and is between about 300° C. per hour and 600° C. per hour. The pitch is converted into a mesophase between 300° and 500° C. The low rate of temperature increase between these temperatures favours the orientation of the crystallites and consequently increases the mechanical strength of the treated fibres. This treatment also makes it possible to improve the yield of the fibres.

An alternative and preferred carbonisation treatment comprises applying a tension of from 2 to 100 mg/denier to the pitch fibres and heating them rapidly to a temperature of up to 1000° C. The rate of increase of temperature may be high e.g. 100° C./h or higher, preferably 300° C./h.

The rate of increase of temperature may vary according to the nature of the initial pitch. Thus, the higher the softening point of a pitch, the higher will be the rate of increase and consequently the shorter will be the treatment times. By way of example, a pitch having a softening point of about 180° C. may be carbonised in about 10 hours.

The rate of flow of carrier gas during carbonisation should be chosen in such a way that it is possible to carry away the different products of carbonisation at rates such that the structure of the fibres is not adversely affected. For fibres carbonised at 1,000° C. it is possible to eliminate completely the small quantity of hydrogen by an additional high-temperature treatment.

Graphitisation, if required, is carried out by a treatment at temperatures at least as high as 2,500° C. The process is usually caried out in a very rapid manner, e.g. for less than 10 minutes and is preferably carried out under tension.

The invention is illustrated by the following examples.

EXAMPLE 1

Three pitches were prepared from a steam cracking residue by a two stage process of continuous distillation at atmospheric pressure followed by a batch distillation under vacuum. The distillation conditions and the characteristics of the pitch produced are set out in Table 1 below.

TABLE 1

| Pitch for Carbon Fibres Manufacture<br>Starting material: Steam Cracking Residue | Pitch 477 | Pitch 482 | Pitch 489 |
|---|---|---|---|
| (1) Continuous distillation | | | |
| Bottom temperature (°C.) | 350 | 350 | 309 |
| Pitch yield (% wt) | 61 | 59.3 | 63.5 |
| Characteristics of the pitch | | | |
| $\alpha + \beta$ resin content | 6.63 | 8.11 | 0 |
| KS softening point (°C.) | <30 | <30 | <30 |
| (2) Vacuum distillation (Batch) | | | |
| Max. Bottom temperature (°C.) | 350 | 346 | 350 |
| Max. Top temperature (°C.) | 300 | 292 | 287 |
| Vacuum (mmHg) | 6–7 | 2 | 6 |
| Pitch yield (% wt) | 43.7 | 44.8 | 39.75 |
| Pitch yield on steam cracking residue | 26.5 | 26.56 | 25.24 |
| Characteristics of the pitch | | | |
| KS softening point (°C.) | 209–213 | 217–220 | 197–198 |
| Viscosity Cp 250° C. | 226838 | 629909 | 37196 |
| 280° C. | 13571 | 41787 | 3575 |
| Resins $\alpha + \beta$ % wt ($\alpha$ < 0.5% wt) | 25 | 31–32 | 7 |
| $\gamma$ % wt | 47.97 | 49.98 | 67.4 |
| $\delta$ % wt | 27 | 17.75 | 25.2 |
| Carbon SERS | 62.14 | 62.3 | 57 |

EXAMPLE 2

Pitch 477 of Example 1 was ground and screened using a screen having apertures of 150 μm, then melted and filtered before being placed in an extrusion cylinder. After de-gassing for 1 hour it was drawn into fibres by the application of a gas pressure (nitrogen so as to avoid oxidation) at a temperature of 250° C. The pitch was extruded through orifices with a diameter of 400 μm situated in the bottom of the cylinder, and the fibres were drawn and wound onto a drum, the speed of winding being variable. In this way a quantity of fibres with diameters of 9 to 40 μm were produced at winding speeds of 500 to 1,500 m per minute.

A tow of 5000 pitch fibres was then placed vertically in an oven and infusibilised by treatment with a gas mixture of 41.2%$SO_2$ and 58.8%$O_2$. The temperature was raised gradually from 20° to 200° C. at a rate of increase of 96° C./hr and the quantities of gas used were 35 liters/hour of $SO_2$ and 50 liters/hour of $O_2$. The $\alpha$ resin content of the infusibilised fibres was 0.72%wt.

The tow of 5,000 infusibilised fibres was carbonised in a flow of $N_2$ (11 liters/hour) and a temperature increase profile of:

| | |
|---|---|
| up to - 300° C. | 100° C./hour |
| 300–500° C. | 30° C./hour |
| 500–1,000° C. | 300° C./hour |

The fibres were tested for diameter ($\phi$), tensile strength (R), elongation at break ($\Delta L/L_m$) and elasticity modulus (E) with the following results.

| | |
|---|---|
| $\phi_m$ | 16.5 micron |
| $R_m$ | 853 N/mm$^2$ |
| $\Delta L/L_m$ | 2.38% |
| $E_m$ | 38589 N/mm$^2$ |

$\phi_m$, $R_m$, $\Delta L/L_m$ and $E_m$ refer to the mean of 17 fibres; the maximum tensile strength for a single fibre was R=1239 N/mm$^2$.

EXAMPLE 3

Pitch 482 of Example 1 was spun into fibres as in Example 2 and infusibilised by treatment with a mixture of $SO_2$ and $O_2$ up to 190° C. and then with $SO_2$ alone up to 270° C. The conditions were thus:

$O_2$—50 liters/hour from 20° to 190° C.

$SO_2$—35 liters/hour from 20° to 270° C.

Rate of temperature increase —90° C./hour

The $\alpha$ resin content of the infusibilised fibres was 1.54 %wt.

The fibres were carbonised and tested as in Example 2 with the following results:

| | | |
|---|---|---|
| based on 13 fibres | $\phi_m$ | 15.9 micron |
| | $R_m$ | 945 N/mm$^2$ |
| | $\Delta L/L_m$ | 1.73% |
| | $E_m$ | 55776 N/mm$^2$ |
| | R maximum | 1204 N/mm$^2$ |

EXAMPLE 4

Pitch 489 of Example 1 was spun into fibres as in Example 2 and infusibilised using $Cl_2$ gas and then $O_2$. The sequence of steps was:

Raise oven temperature to 111° C. with a flow of $N_2$.

Raise oven temperature from 111° C. to 129° C. in 28 minutes with a flow of 98% vol. $N_2$ and 2% vol. $Cl_2$ (2.3 liters/hour of $Cl_2$).

Raise oven temperature from 129° C. to 144° C. in a flow of $N_2$.

Raise oven temperature from 144° C. to 213° C. in 3 hours with a flow of 32% vol. $N_2$ and 68% vol. $O_2$ (58 liters/hour of $O_2$).

The α resin content of the infusibilised fibres was 20.4% by weight.

The fibres were carbonised and tested as in Example 2 with the following results:

| | | |
|---|---|---|
| based on 34 fibres | $\phi_m$ | 10.6 micron |
| | $R_m$ | 939 N/mm$^2$ |
| | $\Delta L/L_m$ | 1.85% |
| | $E_m$ | 50447 N/mm$^2$ |
| | R maximum | 1396 N/mm$^2$ |

EXAMPLE 5

Pitch 489 of Example 1 was spun into fibres as in Example 2 and infusibilised using a gas mixture of:

NO 2.78% vol. (2.36 liters/hour)

$O_2$ 71% vol. (60.3 liters/hour)

$N_2$ balance

The temperature variation was:

Maintained at 16° C. for 7½ hours

Increased from 20° C. to 120° C. at 24° C./hour

The α resin content of the infusibilised fibres was less than 1% by weight.

The fibres were carbonised with a temperature increase of 300° C./h from 20° to 1000° C. with the following results:

| | | |
|---|---|---|
| based on 13 fibres | $\phi_m$ | 7.4 micron |
| | $R_m$ | 1077 N/mm$^2$ |
| | $\Delta L/L_m$ | 2.24% |
| | $E_m$ | 49161 N/mm$^2$ |
| | R maximum | 1542 N/mm$^2$ |

The above experiment was repeated except that the temperature variation used in the infusibilisation process was;

temperature maintained at 5° C. for 9 hours temperature increased from 5° to 120° C. at 12° C./h and the mean fibre diameter was 10 μm The α resin content of the infusibilised fibres was 48% by weight.

The fibres were carbonised as above and the carbon fibres produced had the following properties;

Rm 718 N/mm$^2$

Em 43850 N/mm$^2$

This experiment demonstrates that if the infusibilisation process is not controlled so as to limit the production of α resins then fibres having inferior properties will result. The fibres having an resin content of 48% had a lower tensile strength as well as a lower modulus of elasticity than the fibres containing less than 1% by weight of α resins.

EXAMPLE 6

Pitch 489 of Example 1 was spun into fibres as in Example 2 and infusibilised using a gas mixture of:

NO 1.5% vol. (1.28 liters/hour)

$O_2$ 71% vol. (60.3 liters/hour)

$N_2$ balance

The temperature variation was:

Maintained at 17° C. for 7½ hours

Increased from 20° C. to 120° C. at 12° C./hour

The α resin content of the infusibilised fibres was less than 1% by weight.

The fibres were carbonised and tested as in Example 5 with the following results:

| | | |
|---|---|---|
| based on 17 fibres | $\phi_m$ | 7.4 micron |
| | $R_m$ | 1231 N/mm$^2$ |
| | $\Delta L/L_m$ | 3.1% |
| | $E_m$ | 65972 N/mm$^2$ |
| | R maximum | 1840 N/mm$^2$ |

EXAMPLE 7

Pitch 482 of Example 1 was spun into fibres as in Example 2 and infusibilised by treatment with a mixture of $SO_2$ and $O_2$ up to 200° C. and then with $SO_2$ alone up to 270° C. The conditions were thus:

$O_2$—50 liters/hour from 20° to 200° C.

$SO_2$—35 liters/hour from 20° to 270° C.

Rate of temperature increase 96° C./hour.

The α resin content of the infusibilised fibres was less than 2% by weight.

The fibres were carbonised and tested as in Example 2 with the following results:

| | |
|---|---|
| $\phi_m$ | 15.9 micron |
| $R_m$ | 756 N/mm$^2$ |
| $\Delta L/L_m$ | 1.52% |
| $E_m$ | 48149 N/mm$^2$ |

The carbonised fibres were then graphitised under tension at 2,500° C. in nitrogen for 10 minutes. The elongation was 27%.

24 graphitised fibres were tested and the mean results were:

| | |
|---|---|
| $\phi_m$ | 13.1 micron |
| $R_m$ | 1152 N/mm |
| $\Delta L/L_m$ | 0.9% |
| $E_m$ | 138945 N/mm$^2$ |

EXAMPLE 8

Pitch 489 of Example 1 was spun into fibres as in Example 2 and infusibilised using a gas mixture of NO 1.5% vol (1.3 l/h)

$O_2$ 71%

$N_2$ balance

The temperature was increased from 20° to 120° C. at 12° C./h.

The α resin content of the infusibilised fibres was 1.5% by weight.

The fibres were carbonised under tension in a flow of $N_2$. The temperature increase profile was:

increased from 20° to 1000° C. at 300° C./h maintained at 1000° C. for 5 hours.

The fibres were tested as in Example 2 with the following results,

| | |
|---|---|
| based on 15 fibres | $\phi_m$: 8.0 μm |
| | $R_m$: 1632 N/mm$^2$ |
| | $\Delta L/L_m$; 3.3% |
| | $E_m$: 50175 N/mm$^2$ |
| | R maximum: 1879 N/mm$^2$ |

EXAMPLE 9

Pitch 489 of Example 1 was spun into fibres as in Example 2 and infusibilised using a gas mixture of:

NO 7.3% vol (6.1 l/h)
Air 35% vol
$N_2$ Balance

The temperature was increased from 20° to 170° C. at 96° C./h.

The α resin content of the infusibilised fibres was 1% by weight.

The fibres were carbonized under tension in a flow of $N_2$ and a temperature increase profile of:

increased from 20° C. to 1000° C. at 100° C./h
maintained at 1000° C. for 2 hours.

The fibres were tested as in Example 2 with the following results

| | |
|---|---|
| based on 16 fibres | $\phi_m$: 7.3 μm<br>$R_m$: 1195 N/mm$^2$<br>$\Delta L/L_m$: 1.48%<br>$E_m$: 88406 N/mm$^2$<br>R maximum: 1401 N/mm$^2$ |

EXAMPLE 10

Pitch 489 of Example 1 was spun into fibres as in Example 2 and infusibilised using a gas mixture of:

NO 3% vol (2.6 l/h)
$O_2$ 26% vol
$N_2$ 71% vol

The temperature was increased from 20° to 120° C. at 12° C./h.

The α resin content of the infusibilised fibres was less than 1% by weight.

The fibres were carbonized under tension in a flow of $N_2$ and a temperature increase profile of:

increased from 20° to 1000° C. at 300° C./h
maintained at 1000° C. for 2 hours.

The fibres were tested as in Example 2 with the following results:

$\phi$m: 9.5 μm
Rm: 1000 N/mm2
Em: 50000 N/mm2

EXAMPLES 11 TO 13

The carbonized fibres from Example 10 were then graphitized in argon under tension at 2500° C. The fibres were tested for various elongation ratio during the treatment (Δl/l) with the following results:

| Example | 11 | 12 | 13 |
|---|---|---|---|
| Number of fibres tested | 14 | 37 | 9 |
| Elongation of the fibres $\frac{\Delta l}{l}$ % during the treatment | 39 | 45 | 54 |
| $\phi_m$ (μm) | 6.5 | 6.7 | 5.7 |
| $R_m$ (N/mm$^2$) | 2020 | 2361 | 1851 |
| $E_m$ (N/mm$^2$) | 363030 | 447880 | 605870 |
| Elongation at break $\frac{\Delta L}{L}$ (%) | 0.62 | 0.55 | 0.3 |

I claim:

1. A method of producing carbon from a pitch obtained from a steam cracking residue of a petroleum fraction, which pitch has a β resin content of from 2 to 40% by weight, comprising spinning the pitch into fibres at a temperature higher than the softening point, treating the fibres to render them infusible and then subjecting the fibres to carbonisation by heating, characterised in that the treatment to infusibilize the fibres is controlled such that the α resin content of the fibres does not exceed 30% by weight and said infusibilizing treatment comprising (a) treatment with a mixture of NO and $O_2$ at a temperature not exceeding 200° C., or
(b) treatment with a halogen in gaseous form followed by a treatment with $O_2$ at a temperature not exceeding 250° C., or
(c) treatment with $SO_2$, alone or mixed with $O_2$, at a temperature not exceeding 300° C.

2. A method claimed in claim 1 characterised in that the infusibilisation treatment is such that the α resin content of the fibres does not exceed 25% by weight.

3. A method as claimed in claim 1 characterised in that the infusibilised pitch fibres are carbonised under a tension of from 2 to 100 mg/denier by heating up to 1000° C. at a rate of temperature increase greater than 300° C./hour.

4. A method as in claim 1, 2 or 3 in which the carbon fibres are subsequently subjected to a graphitising step.

5. A method as claimed in claim 4 characterised in that the carbon fibres are graphitised by heating under tension at a temperature of at least 2500° C.

* * * * *